US009374634B2

(12) United States Patent
Macours

(10) Patent No.: US 9,374,634 B2
(45) Date of Patent: Jun. 21, 2016

(54) SYSTEM FOR CONTROLLING DISPLACEMENT OF A LOUDSPEAKER

(71) Applicant: NXP B.V., Eindhoven (NL)

(72) Inventor: Christophe M. Macours, Hodelge (BE)

(73) Assignee: NXP B.V., Eindhoven (NL)

( * ) Notice: Subject to any disclaimer, the term of this patent is extended or adjusted under 35 U.S.C. 154(b) by 124 days.

(21) Appl. No.: 14/327,801

(22) Filed: Jul. 10, 2014

(65) Prior Publication Data

US 2016/0014486 A1 Jan. 14, 2016

(51) Int. Cl.

| | |
|---|---|
| ***H04R 3/00*** | (2006.01) |
| ***H04R 29/00*** | (2006.01) |
| ***H04R 1/02*** | (2006.01) |

(52) U.S. Cl.

CPC .. *H04R 1/02* (2013.01); *H04R 3/00* (2013.01); *H04R 3/007* (2013.01); *H04R 29/001* (2013.01); *H04R 2201/003* (2013.01); *H04R 2201/028* (2013.01); *H04R 2499/11* (2013.01)

(58) Field of Classification Search

None

See application file for complete search history.

(56) References Cited

U.S. PATENT DOCUMENTS

| | | | | |
|---|---|---|---|---|
| 5,068,903 | A | 11/1991 | Walker | |
| 5,528,695 | A | 6/1996 | Klippel | |
| 5,815,585 | A | 9/1998 | Klippel | |
| 7,372,966 | B2 | 5/2008 | Bright | |
| 2003/0210798 | A1 * | 11/2003 | Ohyaba | H04R 3/002 381/96 |
| 2009/0028371 | A1 | 1/2009 | Bailey | |
| 2010/0172516 | A1 | 7/2010 | Lastrucci | |
| 2014/0369512 | A1 * | 12/2014 | Slupeiks | H04R 3/00 381/59 |

FOREIGN PATENT DOCUMENTS

| | | | |
|---|---|---|---|
| EP | 2456229 | A1 | 5/2012 |
| WO | 2012066029 | A1 | 5/2012 |
| WO | 2014/045123 | A2 | 3/2014 |

OTHER PUBLICATIONS

Extended European Search Report for Patent Appln. No. 15173526.3 (Dec. 8, 2015).

Beerling M. et al., Feb. 1994, Reduction of Nonlinear Distortion in Loudspeakers with Digital Motional Feedback, 96th AES Convention.

Birt, D., Oct. 1991, A Motion Transducer for Low-Frequency Loudspeakers, 91st AES Convention.

Uskokovic, M., Sep. 2007, The Use of Optocouplers in Measuring Loudspeaker Cone Displacement, 3rd Congress of the Alps Adria Acoustics Association.

Baltes H. et al., Jan. 2002, CMOS MEMS—Present and Future, 15th IEEE International Conference on Micro Electro Mechanical Systems.

* cited by examiner

*Primary Examiner* — Andrew L Sniezek

(74) *Attorney, Agent, or Firm* — Rajeev Madnawat

(57) ABSTRACT

In an example embodiment, an apparatus includes an enclosure having a loudspeaker mounted therein. The apparatus also includes an IC package mounted inside the enclosure. The IC package includes an amplifier configured to amplify an input audio signal, received at an input of the amplifier, to produce a drive signal. The amplifier is configured to drive the loudspeaker with the drive signal via an output of the amplifier. The IC package also includes a pressure sensor configured to output a status signal, indicative of a sound pressure level inside the enclosure, from an output terminal of the pressure sensor. The apparatus also includes an audio processing circuit connected to the amplifier and configured to adjust strength of the drive signal produced by the amplifier, as a function of the sound pressure level indicated by the status signal.

18 Claims, 4 Drawing Sheets

SYSTEM FOR CONTROLLING DISPLACEMENT OF A LOUDSPEAKER

This disclosure generally relates to loudspeaker systems.

One cause of loudspeaker failures is a mechanical defect that arises when the loudspeaker diaphragm is displaced beyond a certain limit. Such limits are often specified by the loudspeaker manufacturer. Going beyond this displacement limit either damages the loudspeaker immediately, or can considerably reduce its expected lifespan. Some systems limit the displacement of the loudspeaker diaphragm, for example, by analyzing and adjusting an input audio signal with variable cutoff filters (high-pass or other), a gain stage, or a dynamic range compression module, based on various parameters of the audio signal. For instance, loudspeaker characteristics may be modeled to map displacement of a loudspeaker relative to amplitude of an input signal. The model predicts the displacement of the loudspeaker, also referred to as cone excursion, which can be linear or non-linear. The control system can be used for loudspeaker protection, as mentioned above, as well as linearization of the loudspeaker output. The input signal is typically pre-processed in such a way that the amplitude of an input audio signal is kept below a specified amplitude.

Various example embodiments are directed to circuits and methods for controlling displacement of a loudspeaker in an enclosure. In an example embodiment, an apparatus includes an enclosure having a loudspeaker mounted therein. The apparatus also includes an IC package mounted inside the enclosure. The IC package includes an amplifier configured to amplify an input audio signal, received at an input of the amplifier, to produce a drive signal. The amplifier is configured to drive the loudspeaker with the drive signal, via an output of the amplifier. The IC package also includes a pressure sensor configured to output a status signal, indicative of a sound pressure level inside the enclosure, from an output terminal of the pressure sensor. The apparatus also includes an audio processing circuit connected to the amplifier and configured to adjust the strength of the drive signal produced by the amplifier as a function of the sound pressure level indicated by the status signal.

A method is also disclosed for controlling displacement of a loudspeaker in an enclosure. An input audio signal is amplified, using an amplifier in an IC package mounted inside the enclosure, to generate a drive signal. The loudspeaker is driven with the drive signal. A pressure level inside the enclosure is measured using a pressure sensor in the IC. The strength of the drive signal is adjusted as a function of the measured pressure level.

The above discussion/summary is not intended to describe each embodiment or every implementation of the present disclosure. The figures and detailed description that follow also exemplify various embodiments.

Various example embodiments may be more completely understood in consideration of the following detailed description in connection with the accompanying drawings, in which.

Figure 1:
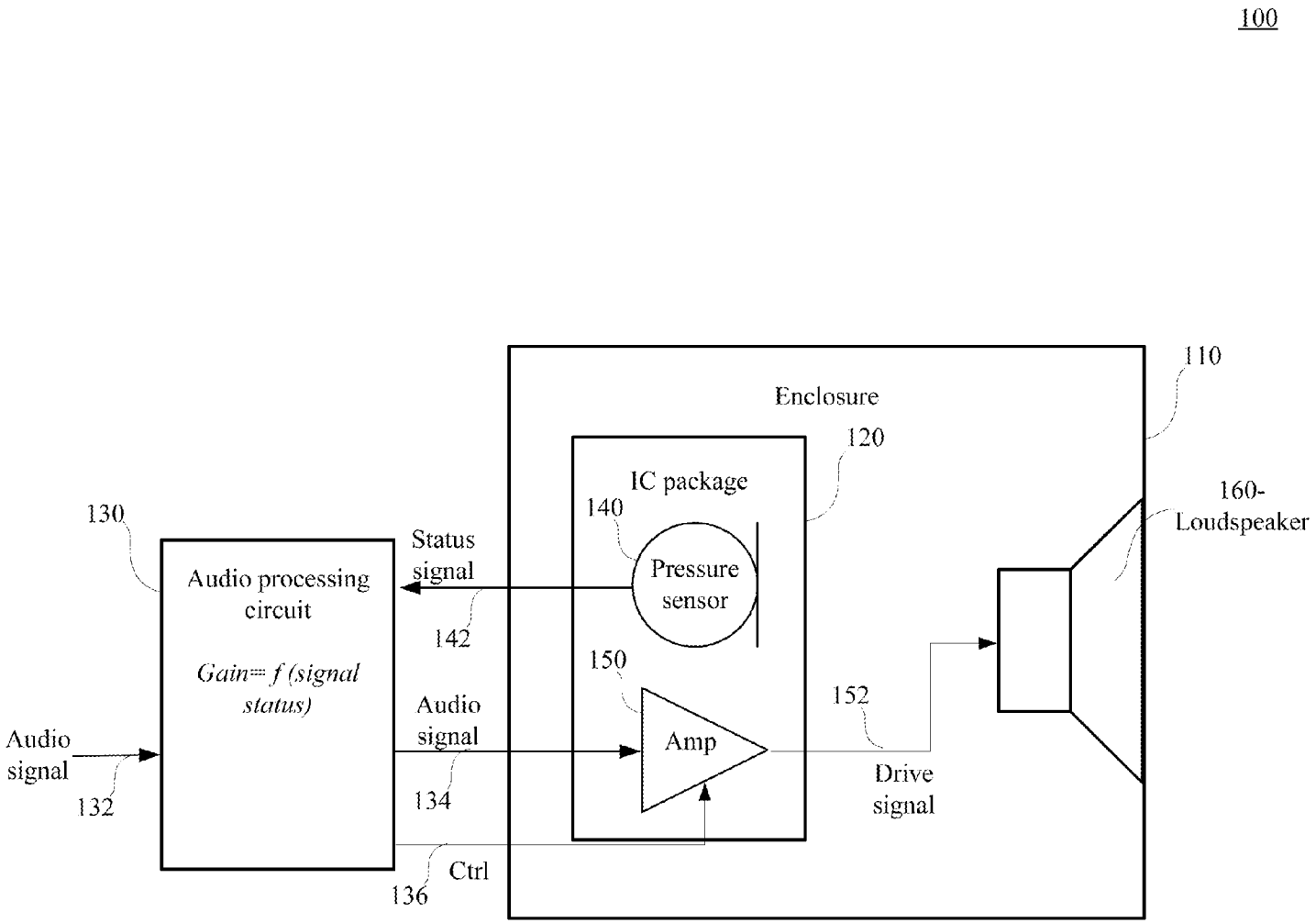
FIG. 1 shows a first loudspeaker system, configured in accordance with one or more embodiments.

While various embodiments discussed herein are amenable to modifications and alternative forms, aspects thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the disclosure including aspects defined in the claims. In addition, the term "example" as used throughout this application is only by way of illustration, and not limitation.

Aspects of the present disclosure are believed to be applicable to a variety of different types of apparatuses, systems and methods for controlling a loudspeaker in an enclosure. While not necessarily so limited, various aspects may be appreciated through a discussion of examples using this context.

In some embodiments, an IC package and a loudspeaker are mounted in an enclosure. The IC package includes an amplifier configured to amplify an input audio signal, received at an input of the amplifier, to produce a drive signal. The amplifier is configured to drive the loudspeaker with the drive signal via an output of the amplifier. The IC package also includes a pressure sensor configured to output a status signal, indicative of a sound pressure level inside the enclosure, from an output terminal of the pressure sensor. The apparatus also includes an audio processing circuit, which is connected to the amplifier and configured to adjust strength of the drive signal produced by the amplifier as a function of the sound pressure level indicated by the status signal.

In some embodiments, the gain control signal is configured to adjust the strength of the drive signal, based on the sound pressure level, to prevent the displacement of the loudspeaker from exceeding a threshold displacement. For example, the audio processing circuit may determine a displacement of the loudspeaker from the measured sound pressure level and adjust the strength of the drive signal, based on the determined displacement of the loudspeaker, to prevent the displacement of the loudspeaker from exceeding a threshold displacement. The threshold displacement may be set, for example, to be equal to a maximum safe displacement specified by the manufacturer of the loudspeaker.

The pressure sensor may be implemented using various devices sensitive to variations in atmospheric pressure, such as microphones or piezo-resistive pressure sensors. For ease of explanation, the examples may be discussed primarily with reference to a pressure sensor implemented using a micro-electro-mechanical system (MEMS) microphone. In some embodiments, the pressure sensor may be implemented using lower sensitivity microphones, which are insensitive to a portion of the audible frequency range. In some embodiments, the pressure sensor may only be sensitive to frequencies at which extreme displacement may occur (e.g., around the resonant frequency of the loudspeaker). For example, the pressure sensor may only be sensitive to a relatively small frequency band, spanning approximately 4 kHz.

Similarly, in some implementations, the pressure sensor may only be sensitive to pressure levels at which extreme displacement may occur. In some applications, the pressure sensor may be insensitive to a range of sound pressure levels up to approximately 20 decibels below a sound pressure level corresponding to a maximum rated displacement of the loudspeaker (e.g., 150 decibels). For example, in one application the pressure sensor may be insensitive to sound pressure levels below 100 decibels.

Off the shelf microphones may not be capable of measuring pressures at which extreme displacement of the loudspeaker may occur. For example, a signal generated by an of the shelf microphone may become saturated before pressures characteristic of extreme displacement are reached. Moreover, off the shelf microphones may be damaged by pressures at which extreme displacement of the loudspeaker may occur. In some embodiments, the pressure sensor is implemented using a microphone, configured and arranged to operate at sound pressure levels greater than 120 decibels.

In some embodiments, the pressure sensor may be configured to measure one or both of an alternating current (AC) variation in the pressure and a DC offset of the pressure, relative to a resting state of the loudspeaker. In contrast, off the shelf microphones are not configured to measure DC offset of sound pressure. The audio processing circuit may be configured to adjust the drive signal, based on measured DC bias of the pressure, to remove a DC offset of the drive signal.

The audio processing circuit may adjust the drive signal using various control mechanisms. In some implementations, the audio processing circuit is configured to adjust strength of the drive signal produced by the amplifier by adjusting a gain setting of the amplifier via a control signal. Alternatively or additionally, the audio processing circuit is configured to adjust the strength of the drive signal by adjusting the strength of the audio signal that is input to the amplifier and used to derive the drive signal.

In various embodiments, the pressure sensor and the amplifier are included in the IC package mounted inside the enclosure. In some embodiments, the audio processing circuit is in a separate IC package mounted outside of the enclosure. In some other embodiments, the audio processing circuit, the pressure sensor, and the amplifier are all located in the IC package mounted inside the enclosure.

Turning now to the figures, FIG. 1 shows a first loudspeaker system, configured in accordance with one or more embodiments. The system includes a loudspeaker 160 mounted in a speaker enclosure 110. An IC package 120 is also mounted inside the speaker enclosure 110. The IC package 120 includes an amplifier 150 that is configured to amplify an input audio signal 134 to produce a drive signal 152 and drive loudspeaker 160 with the drive signal. The IC package 120 also includes a pressure sensor 140 configured to generate a status signal 142, indicative of a sound pressure level (SPL) inside of the enclosure. In some implementations, the amplifier 150 is isolated from the output of the pressure sensor 140 within the IC package 120. The system includes an audio processing circuit 130, electrically connected to receive the status signal 142 output by the pressure sensor 140. The audio processing circuit 130 is configured to adjust various parameters of the drive signal, based on the status signal 142 (e.g., to reduce distortion or to prevent damage to the loudspeaker via excessive displacement). The audio processing circuit 130 may adjust the drive signal using various signal processing functions including, for example, limiters, compressors, and/or band pass filters.

In a sealed speaker enclosure, acoustic pressure inside of the enclosure changes proportionally to changes in the volume of the enclosure, caused by displacement of the loudspeaker. Assuming acoustic pressure to be constant throughout the enclosure, acoustic pressure P(t) is determined by:

$$P(t) = \frac{-\Delta V(t)}{V_0} * \rho c^2$$

where $V_0$ is the volume when the diaphragm is in its rest position, ρ is the density of air and c is the speed of sound. The volume change is caused by a displacement x(t) of the loudspeaker, with respect to a resting position (an outward displacement corresponds to a positive displacement), as determined by:

$$\Delta V(t) = x(t) S_d$$

where $S_d$ is the effective diaphragm radiating area. Accordingly, $$P(t) = \frac{-x(t) S_d}{V_0} * \rho c^2.$$

When the loudspeaker 160 in FIG. 1 is displaced by the drive signal 152, the volume of the enclosure and the pressure within the enclosure are changed. In various embodiments, the audio processing circuit 130 adjusts various parameters of the drive signal 152, based on a pressure level inside the enclosure indicated by status signal 142.

In some embodiments, the audio processing circuit 130 is configured to adjust amplitude of the drive signal 152, based on the indicated pressure level, to prevent displacement of the loudspeaker 160 from exceeding a threshold displacement. In some implementations, the audio processing circuit 130 may adjust the amplitude of the drive signal 152 by adjusting a gain of the amplifier 150 via a control signal 136. In some other implementations, audio processing circuit 130 may adjust the amplitude of the drive signal 152 by adjusting an amplitude of the audio signal 134 provided to the amplifier 1150. For example, the audio processing circuit 130 may amplify' an input audio signal 132, with a gain setting selected as a function of the status signal 142, to produce the audio signal 134 provided to the amplifier 150 in the IC package. The audio processing circuit may adjust the drive signal using various signal processing functions including, for example, limiters, compressors, and/or band pass filters. In some other applications, the audio processing circuit 130 may adjust the drive signal based on the indicated pressure level, to reduce distortion exhibited by the system. For instance, for a smartphone application, the audio processing circuit 130 may be configured to use the status signal 142 for acoustic echo cancellation (AEC).

The pressure sensor 140 may be implemented using various sensors, such as microphones, which are sensitive to variations in air pressure. Microphone are generally manufactured as separate components that may be used in various applications. To increase the applications for which microphones may be used, they are generally designed to accurately sense sound without distortion within frequency and amplitude ranges audible by most people. However, such accuracy is not required for some embodiments. For instance, a loudspeaker may only be subject to damage from extreme displacement within a small range of frequencies and/or amplitudes. In some embodiments, the pressure sensor is implemented using a lower accuracy microphone that is only responsive to a sub-set of audible frequency and amplitude ranges. For example, in some implementations, the microphone is insensitive to sound pressure levels below 100 decibels. As another example, the microphone may only be sensitive to frequencies at which extreme displacement may occur. In some implementations, the microphone may only be sensitive to a relatively small frequency band spanning approximately 4 kHz. Some types of microphones may not be operable at pressure levels at which the loudspeaker may become damaged. In some embodiments, the pressure sensor is implemented using a high durability microphone configured to operate at sound pressure levels greater than 120 decibels.

By using microphone that are less sensitive and/or that have a smaller frequency range of operation, manufacturing costs for the pressure sensor and system may be reduced. Manufacturing costs are also reduced by implementing the pressure sensor 140 and amplifier 150 in the same IC package. Even though the pressure sensor is not connected to or used by the amplifier in the IC package, by placing these components in the same IC package both of these devices can be mounted in the speaker enclosure 110 at the same time.

During operation of the loudspeaker 160, a diaphragm of the loud speaker is displaced outward and inward according to the drive signal 152. The outward and inward displacement creates variation in the pressure inside the enclosure 110, which can be modeled as an AC signal that is proportional to the drive signal. However, outward displacement of the loudspeaker 160 is not necessarily the same as the inward displacement of the loudspeaker. For instance, a direct current (DC) bias in the drive signal 152 may cause outward and inward displacements to be unequal, which may produce audible distortion or result in damage to the loudspeaker. In some embodiments, the status signal 142 output by the pressure sensor 140 includes an AC component indicative of variation in pressure inside the enclosure and a DC component indicative of a bias of the pressure inside the enclosure relative to a pressure exhibited inside the enclosure when the loudspeaker is at rest. In some implementations, the audio processing circuit 130 is configured to adjust the drive signal 152 to remove a DC offset of the drive signal based on the direct current component of the status signal. In some implementations, the pressure sensor 140 includes a single sensor configured to provide both AC and DC components of the status signal 142. In some other implementations, pressure sensor 140 includes a first sensor (not shown) configured to provide the AC component and a second sensor (not shown) configured to provide the DC component.

Figure 2:
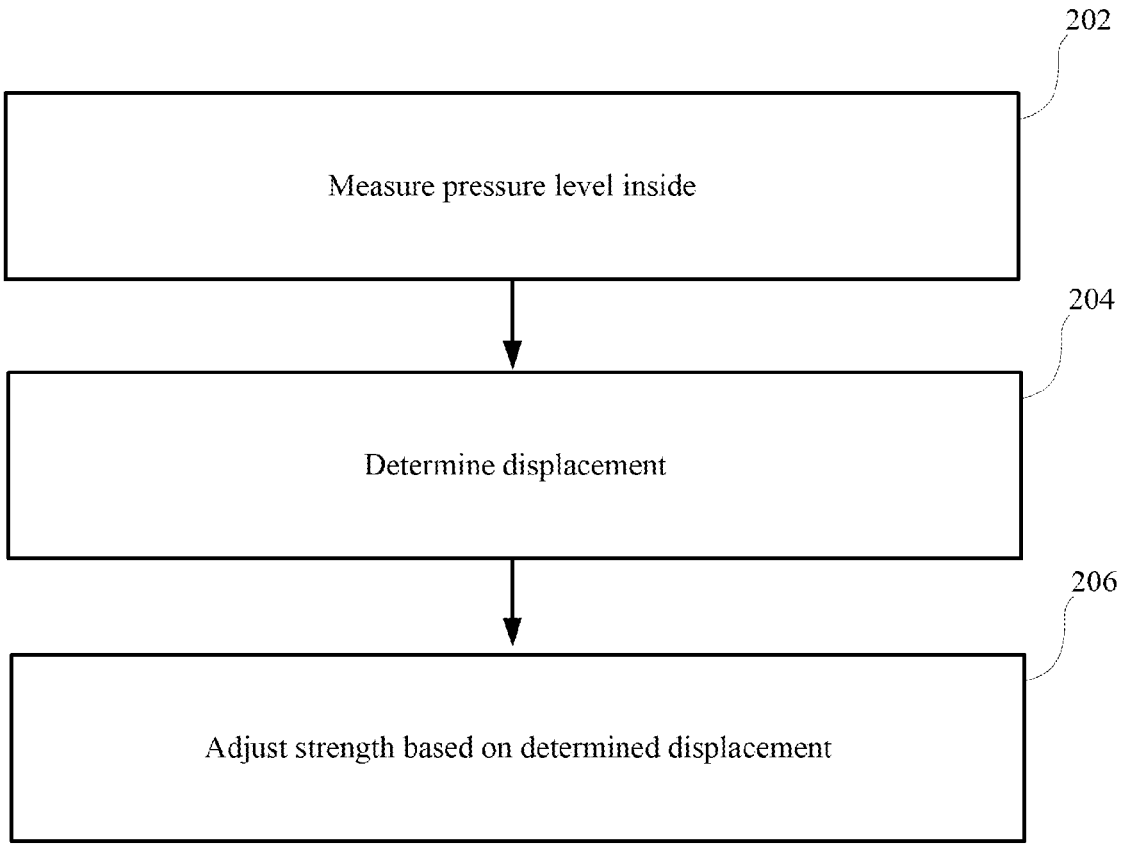
FIG. 2 shows a process for adjusting a signal used to drive a loudspeaker, in accordance with one or more embodiments.

FIG. 2 shows a process for adjusting a signal used to drive a loudspeaker, in accordance with one or more embodiments. In one particular example embodiment, at block 202, pressure level inside a speaker enclosure is measured for a subset of frequencies and/or amplitudes at which a loudspeaker is subject to extreme displacement. At block 204, displacement of the loudspeaker is determined from the measured pressure level. The displacement may be determined, for example, using a conversion function or using a stored lookup table, which maps pressure levels relative to displacement of the speaker. At block 206, the strength of a drive signal used to drive the loudspeaker is adjusted, based on the determined displacement, to prevent the displacement of the loudspeaker from exceeding a maximum safe displacement.

Figure 3:
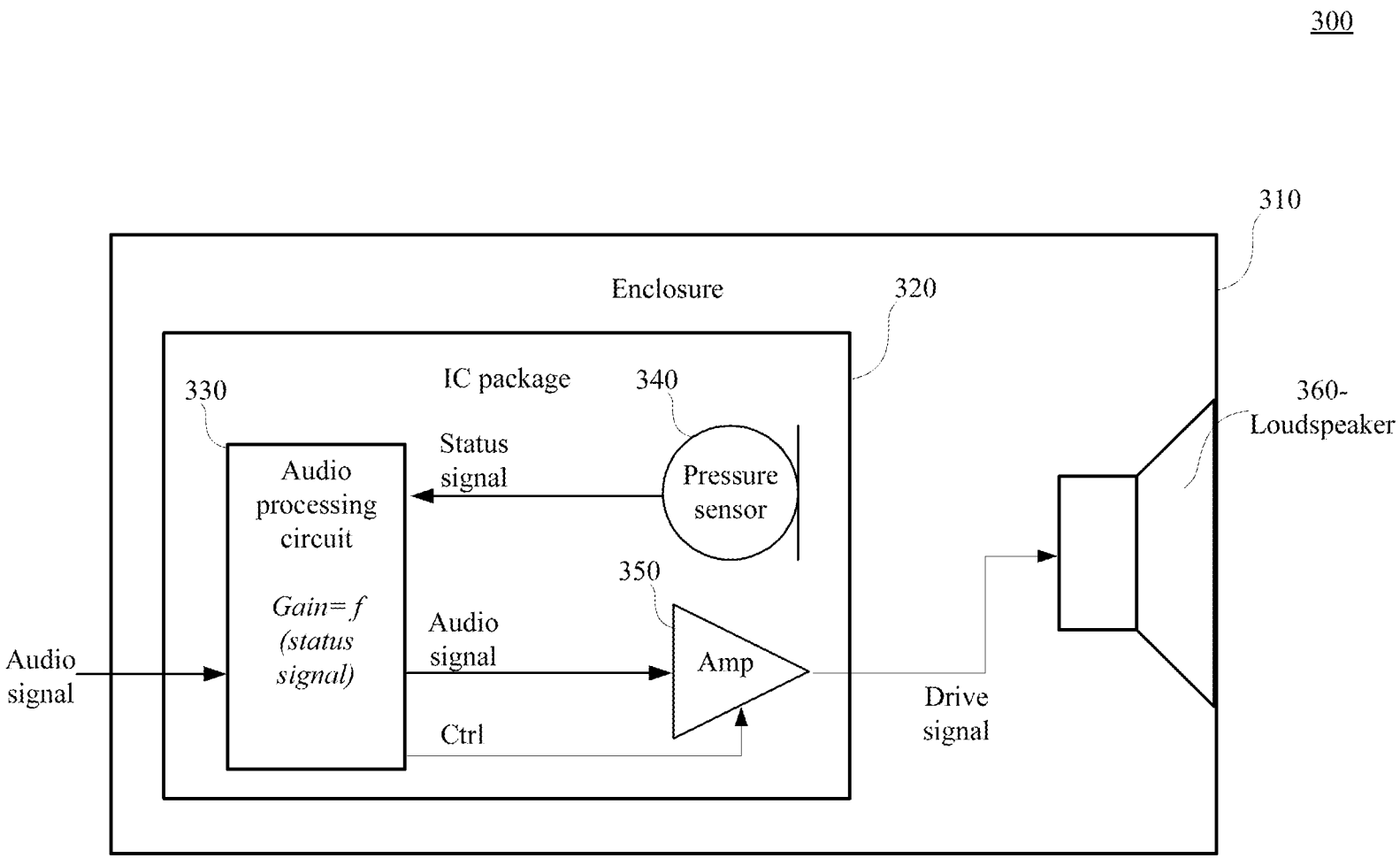
FIG. 3 shows a second loudspeaker system, configured in accordance with one or more embodiments.

FIG. 3 shows a second loudspeaker system, configured in accordance with one or more embodiments. In one particular example embodiment, the system includes an enclosure 310, an audio processing circuit 330, a pressure sensor 340, an amplifier 350, and a loudspeaker 360, similar to the enclosure 110, audio processing circuit 130, pressure sensor 140, amplifier 150, and loudspeaker 160, as described with reference to FIG. 1.

In this example, the audio processing circuit 330, the pressure sensor 340, and the amplifier 350 are included in the same IC package 320, which is mounted inside the enclosure. Incorporating the audio processing circuit 330, the pressure sensor 340, and the amplifier 350 in the same IC package 320 may reduce the size of the system, which may be preferred for some compact applications.

The IC package may include various numbers of substrates upon which the audio processing circuit 330, the pressure sensor 340, and the amplifier 350 may be placed. In some implementations, the audio processing circuit 330, the pressure sensor 340, and the amplifier 350 are placed on respective substrates in the IC package. In some other implementations, the audio processing circuit 330, the pressure sensor 340, and the amplifier 350 are placed on the same substrate.

Figure 4:
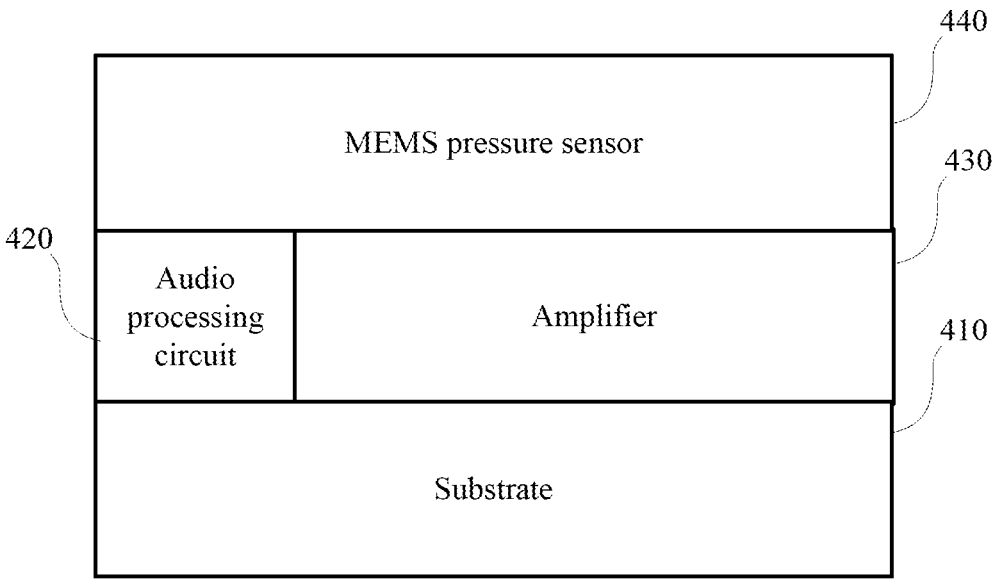
FIG. 4 shows a semiconductor device, configured in accordance with one or more embodiments.

FIG. 4 shows an example semiconductor device, consistent with one or more embodiments. The device includes an audio processing circuit 420 and an amplifier 430, placed on a substrate 410. In this example, a MEMS pressure sensor 440 is placed on top of the audio processing circuit 420 and amplifier 430. In some other implementations, the MEMS pressure sensor 440 may be placed directly on the substrate 410 in an area adjacent to the audio processing circuit 420 and/or the amplifier 430.

Various blocks, modules or other circuits may be implemented to carry out one or more of the operations and activities described herein and/or shown in the figures. In these contexts, a "block" (also sometimes "logic circuitry" or "module") is a circuit that carries out one or more of these or related operations/activities (e.g., gain control or amplification). For example, in certain of the above-discussed embodiments, one or more modules are discrete logic circuits or programmable logic circuits configured and arranged for implementing these operations/activities, as in the circuit modules shown in FIGS. 1, 3, and 4. In certain embodiments, such a programmable circuit is one or more computer circuits programmed to execute a set (or sets) of instructions (and/or configuration data). The instructions (and/or configuration data) can be in the form of firmware or software stored in and accessible from a memory (circuit). As an example, first and second modules include a combination of a CPU hardware-based circuit and a set of instructions in the form of firmware, where the first module includes a first CPU hardware circuit with one set of instructions and the second module includes a second CPU hardware circuit with another set of instructions.

Certain embodiments are directed to a computer program product (e.g., nonvolatile memory device), which includes a machine or computer-readable medium having stored thereon instructions which may be executed by a computer (or other electronic device) to perform these operations/activities.

Based upon the above discussion and illustrations, those skilled in the art will readily recognize that various modifications and changes may be made to the various embodiments without strictly following the exemplary embodiments and applications illustrated and described herein. For example, though aspects and features may in some cases be described in individual figures, it will be appreciated that features from one figure can be combined with features of another figure even though the combination is not explicitly shown or explicitly described as a combination. Such modifications do not depart from the true spirit and scope of various aspects of the invention, including aspects set forth in the claims.

What is claimed is:

1. An apparatus, comprising:

an enclosure;

a loudspeaker mounted to the enclosure;

an integrated circuit (IC) package mounted inside the enclosure, the IC package including:

an amplifier having an input terminal and an output terminal, the amplifier being configured and arranged to amplify an audio signal received by the input to produce a drive signal and drive the loudspeaker with the drive signal via the output terminal;

a pressure sensor having an output terminal, the pressure sensor configured and arranged to output a status signal, indicative of a sound pressure level inside the enclosure, from the output terminal; and an audio processing circuit having an input for receiving the audio signal, a first output for outputting an amplitude adjusted to the amplifier and a second output for outputting a control signal to the amplifier for amplitude adjustment of the audio signal, the audio processing circuit is configured and arranged to adjust a strength of the drive signal produced by the amplifier as a function of the sound pressure level indicated by the status signal.

2. The apparatus of claim 1, wherein the output terminal of the pressure sensor is electrically isolated from the input terminal of the amplifier within the IC package.

3. The apparatus of claim 1, wherein the audio processing circuit is configured to determine displacement of the loudspeaker based on the pressure level indicated by the status signal; and adjust strength of at least a portion of the drive signal produced by the amplifier, as a function of the determined displacement, to prevent displacement of the loudspeaker from exceeding a threshold displacement.

4. The apparatus of claim 3, wherein the pressure sensor is a micro electro mechanical system (MEMS) microphone that is operable at sound pressure levels exhibited within the enclosure when the loudspeaker exceeds the threshold displacement.

5. The apparatus of claim 4, wherein:

the MEMS microphone is operable at sound pressure levels greater than 120 decibels; and is insensitive to sound pressure levels below 100 decibels.

6. The apparatus of claim 3, wherein the wherein the pressure sensor is a micro electro mechanical system (MEMS) microphone that is insensitive to frequencies outside an operable frequency band having a bandwidth of approximately 4 kHz.

7. The apparatus of claim 6, wherein the operable frequency band includes frequencies at which the loudspeaker is susceptible to excursion.

8. The apparatus of claim 1, wherein:

the status signal output by the pressure sensor includes:

an alternating current (AC) component indicative of variation in pressure inside the enclosure; and a direct current (DC) component indicative of a bias of the pressure inside the enclosure relative to a pressure exhibited inside the enclosure when the loudspeaker is at rest; and the audio processing circuit is configured to adjust the drive signal to remove a DC offset of the drive signal based on the DC component of the status signal.

9. The apparatus of claim 8, wherein the pressure sensor includes a first sensor configured to measure the variation in pressure inside the enclosure and generate the AC component of status signal;

a second sensor configured to measure the bias of the pressure inside the enclosure and generate the DC component of status signal.

10. The apparatus of claim 1, wherein:

the driving of the loudspeaker with the drive signal induces variation in the pressure inside the enclosure;

the status signal output by the pressure sensor indicates a direct current (DC) bias of the pressure inside the enclosure relative to a pressure exhibited inside the enclosure when the loudspeaker is at rest; and the audio processing circuit is configured to adjust the drive signal to remove a DC offset of the drive signal based on the DC bias of the pressure indicated by the status signal.

11. The apparatus of claim 1, wherein the audio processing circuit is configured and arranged to adjust the strength of the drive signal produced by the amplifier, as a function of the status signal, to prevent the loudspeaker from generating a sound pressure level within the enclosure that exceeds a value stored on the audio processing circuit.

12. The apparatus of claim 1, wherein the audio processing circuit is configured and arranged to receive a first audio signal; and adjust the strength of the drive signal produced by the amplifier, as a function of the status signal by determining a gain as a function of the status signal, amplifying the first audio signal with the determined gain to produce a second audio signal, and providing the second audio signal to the input terminal of the amplifier.

13. The apparatus of claim 1, wherein the audio processing circuit is configured and arranged to generate a gain control signal, as a function of the status signal; and the amplifier is configured to amplify the audio signal using a gain indicated by the gain control signal.

14. The apparatus of claim 1, wherein the audio processing circuit is placed outside of the enclosure.

15. The apparatus of claim 1, wherein the audio processing circuit is included within the IC package.

16. The apparatus of claim 1, wherein the amplifier and the pressure sensor are placed on a first substrate.

17. The apparatus of claim 16, wherein the pressure sensor is placed on the amplifier and is separated from the substrate by the amplifier.

18. The apparatus of claim 16, wherein the audio processing circuit is placed on the first substrate.

* * * * *